United States Patent [19]

Apodaca

[11] Patent Number: 5,037,030

[45] Date of Patent: Aug. 6, 1991

[54] SPRINKLER HEAD GUARD

[76] Inventor: Willie Apodaca, 416 W. Andrix St., Monterey Park, Calif. 91754

[21] Appl. No.: 484,997

[22] Filed: Feb. 26, 1990

[51] Int. Cl.[5] ..... B05B 15/04

[52] U.S. Cl. ..... 239/288

[58] Field of Search ..... 239/200–206, 239/288, 288.3, 288.5

[56] References Cited

U.S. PATENT DOCUMENTS

| | | | |
|---|---|---|---|
| 3,662,956 | 5/1972 | Hedman | 239/288.5 X |
| 3,904,120 | 9/1975 | Sbicca | 239/288.5 X |
| 4,108,439 | 8/1978 | McGuire | 239/201 X |
| 4,351,477 | 9/1982 | Choi | 239/DIG. 1 |
| 4,391,005 | 7/1983 | Goettl | 239/204 X |

*Primary Examiner*—Andres Kashnikow
*Assistant Examiner*—Kevin Weldon
*Attorney, Agent, or Firm*—Leon Gilden

[57] ABSTRACT

An apparatus including a main support block of a generally parallelepiped cross-sectional configuration defined by a central bore directed therethrough, wherein the central bore receives and protects a sprinkler head in a surrounding relationship and wherein the central bore includes a knock-out section of the central bore to enlarge the central bore to increased area to receive a larger sprinkler head therewithin. The invention includes a modification wherein the main support block includes a secondary support block structure to permit stacking, with the secondary support block including projections at corners of the support block directed downwardly therefrom receivable within registration bores coaxially aligned with the projections to permit stacking of the organization to a predetermined height. The secondary support block may be formed of an absorbent stone or polymeric to permit absorption of various chemicals such as weed killer and the like to limit weed and grass growth overlying the organization.

5 Claims, 4 Drawing Sheets

PRIOR ART

SPRINKLER HEAD GUARD

BACKGROUND OF THE INVENTION

1. Field of the Invention

The field of invention relates to sprinkler head protective devices, and more particularly pertains to a new and improved sprinkler head guard positioned in a surrounding relationship relative to a sprinkler head for protection of the sprinkler head and minimize plant growth thereabout providing limited obstruction to a guard in the sprinkler head and its dispersion about an associated lawn or garden.

2. Description of the Prior Art

Sprinkler heads and guards of various types have been provided in the prior art. The need for sprinkler head guards is well known to minimize and limit damage to such sprinkler head guards that are typically secured to an underlying water manifold system. Inadvertent stepping upon or contact with these heads by individuals or lawn attending equipment has resulted in damage to the equipment and the attendant cost of repair and maintenance thereof. Examples of the prior art include U.S. Pat. No. 3,904,120 to Sbicca wherein a disk-like member is positioned in a surrounding relationship relative to a sprinkler head, with a series of grass simulating protrusions directed upwardly of the disk.

U.S. Pat. No. 4,145,003 to Harrison, et al., sets forth a one-piece sprinkler guard providing a recessed channel for positioning underneath a ground surface for protecting of components of the sprinkler conduit system.

U.S. Pat. No. 4,146,181 to Soss provides a ring guard for a lawn sprinkler head for mounting flushly with the ground, with a central upwardly projecting ring formed with stabilizer fins to mount the apparatus relative to the sprinkler head.

U.S. Pat. No. 4,582,256 to Jaquez sets forth a sprinkler head guard with a bottom surface area greater than a top surface area to enhance stability of the guard overlying a sprinkler head.

U.S. Pat. No. 3,762,642 to Disanto sets forth a grass guard comprising a plate-like member including two or more complementary sections securable together to surround and prevent grass growth underlying an associated sprinkler head.

As such, it may be appreciated that there continues to be a need for a new and improved sprinkler head guard wherein the same addresses both the problems of ease of use, as well as versatility in application to a variety of surface and vegetation conditions and in this respect, the present invention substantially fulfills this need.

SUMMARY OF THE INVENTION

In view of the foregoing disadvantages inherent in the known types of sprinkler head guards now present in the prior art, the present invention provides a sprinkler head guard wherein the same provides a structure readily positionable about a sprinkler head and adaptable to a variety of vegetation and ground surface conditions. As such, the general purpose of the present invention, which will be described subsequently in greater detail, is to provide a new and improved sprinkler head guard which has all the advantages of the prior art sprinkler head guards and none of the disadvantages.

To attain this, the present invention provides an apparatus including a main support block of a generally parallelepiped cross-sectional configuration defined by a central bore directeed therethrough, wherein the central bore receives and protects a sprinkler head in a surrounding relationship, and wherein the central bore includes a knock-out section of the central bore to enlarge the central bore to increased area to receive a larger sprinkler head therewithin. The invention includes a modification wherein the main support block includes a secondary support block structure to permit stacking, with the secondary support block including projections at corners of the support block directed downwardly therefrom receivable within the registration bores coaxially aligned with the projections to permit stacking of the organization to a predetermined height. The secondary support block may be formed of an absorbent stone or polymeric to permit absorption of various chemicals such as weed killer and the like to limit weed and grass growth overlying the organization.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved sprinkler head guard which has all the advantages of the prior art sprinkler head guards and none of the disadvantages.

It is another object of the present invention to provide a new and improved sprinkler head guard which may be easily and efficiently manufactured and marketed.

It is a further object of the present invention to provide a new and improved sprinkler head guard which is of a durable and reliable construction.

An even further object of the present invention is to provide a new and improved sprinkler head guard which is susceptible of a low cost of manufacture with regard to both materials and labor, and which accordingly is then susceptible of low prices of sale to the consuming public, thereby making such sprinkler head guards economically available to the buying public.

Still yet another object of the present invention is to provide a new and improved sprinkler head guard which provides in the apparatuses and methods of the prior art some of the advantages thereof, while simultaneously overcoming some of the disadvantages normally associated therewith.

Still another object of the present invention is to provide a new and improved sprinkler head guard wherein the same accommodates a variety of sprinkler head diameters, as well as accommodating individual user's needs for varying height of protection about a sprinkler head guard.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
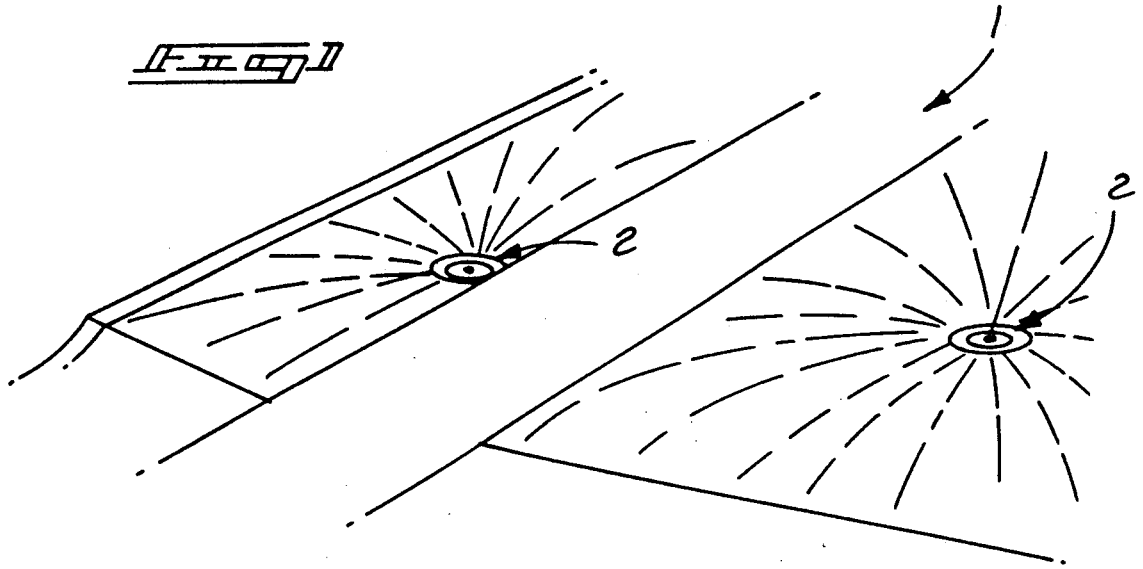
FIG. 1 is a diagrammatic isometric illustration of a typical sprinkler head orientation within a lawn environment.

With reference now to the drawings, and in particular to FIGS. 1 to 9 thereof, a new and improved sprinkler head guard embodying the principles and concepts of the present invention and generally designated by the reference numerals 10, 10*a*, and 10*b* will be described.

FIG. 1 diagrammatically illustrates a prior art apparatus 1 wherein a series of protector guards 2 are positioned in a surrounding relationship relative to associated sprinkler heads within a lawn or garden environment.

Figure 2:
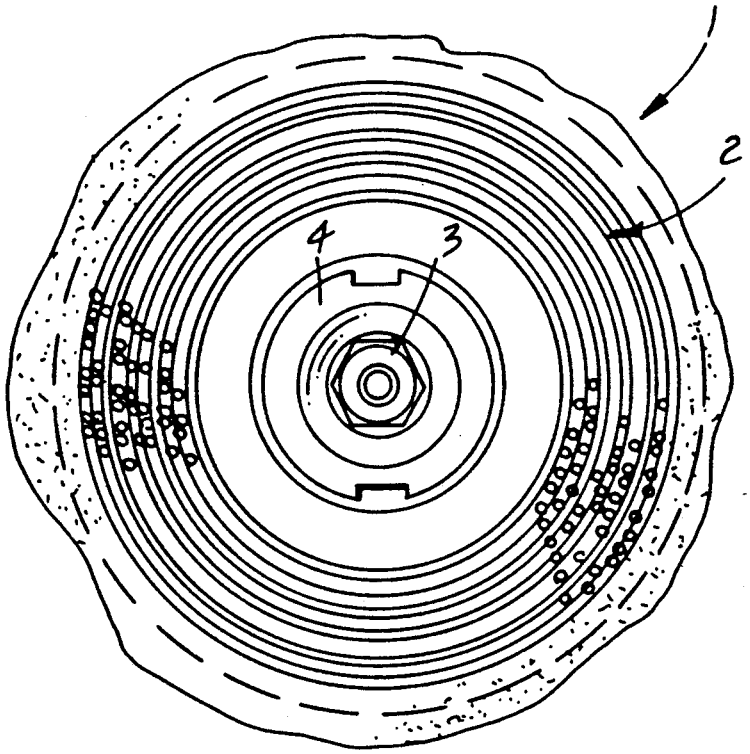
PRIOR ART Fig 2
FIG. 2 is a top orthographic view of a prior art sprinkler head guard apparatus.
Figure 3:
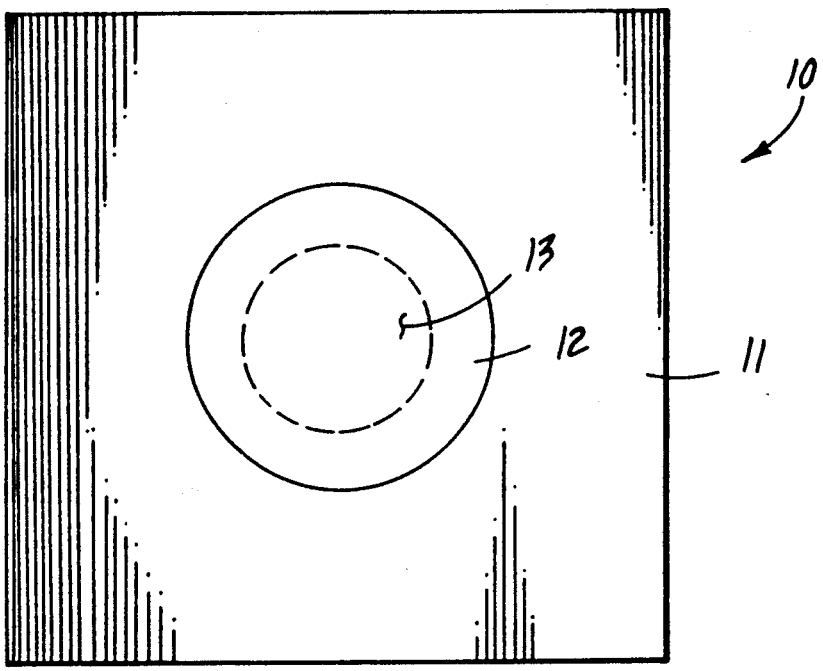
FIG. 3 is a top orthographic view of the instant invention.
Figure 4:
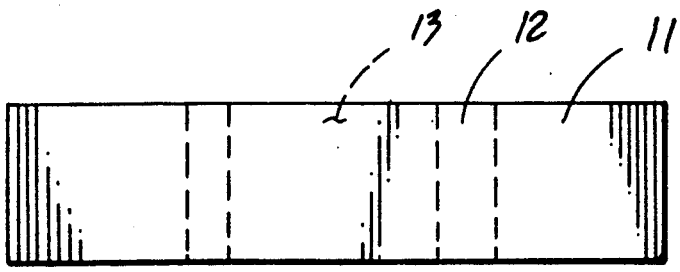
FIG. 4 is an orthographic side view taken in elevation of the instant invention.

FIG. 2 illustrates the protective guards 2 as an annular, cylindrical configuration receiving a sprinkler head 3 medially and coaxially thereof formed within a recess 4 of the guard surface.

More specifically, the sprinkler head guard 10 of the instant invention essentially comprises a main support block 11 defined by a generally parallelepiped cross-sectional configuration of a predetermined height. A central cylindrical bore 13 is defined coaxially and orthogonally relative to the top and bottom surfaces of the main support block, and includes a tubular knock-out section 12 to accommodate sprinkler heads 3 of a greater diameter. The main support block is positioned in a surrounding relationship relative to a sprinkler head, and is typically formed of a polymeric type material, and accordingly permits a gardener and the like to perform gardening functions directly over an associated sprinkler head without damage to the head by lawn mower blades, wheels, and the like. The polymeric construction minimizes damage to garden equipment, such as lawn mower blades, and wherein the support block is positioned generally one-fourth to one inch below existing or desired grass height.

Figure 5:
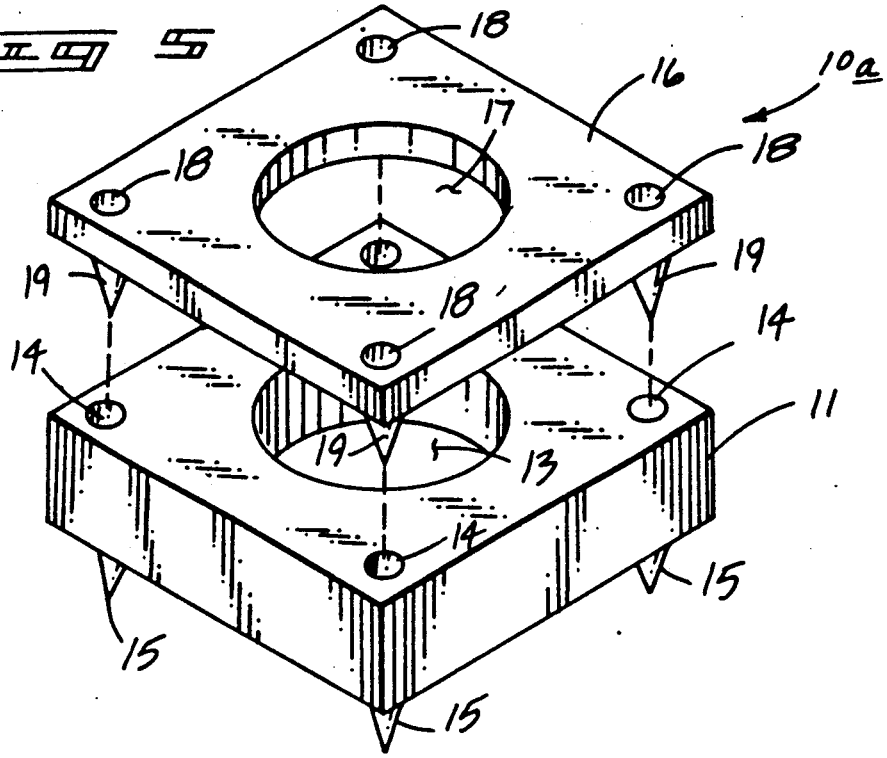
FIG. 5 is an isometric illustration of a modification of the instant invention.
Figure 6:
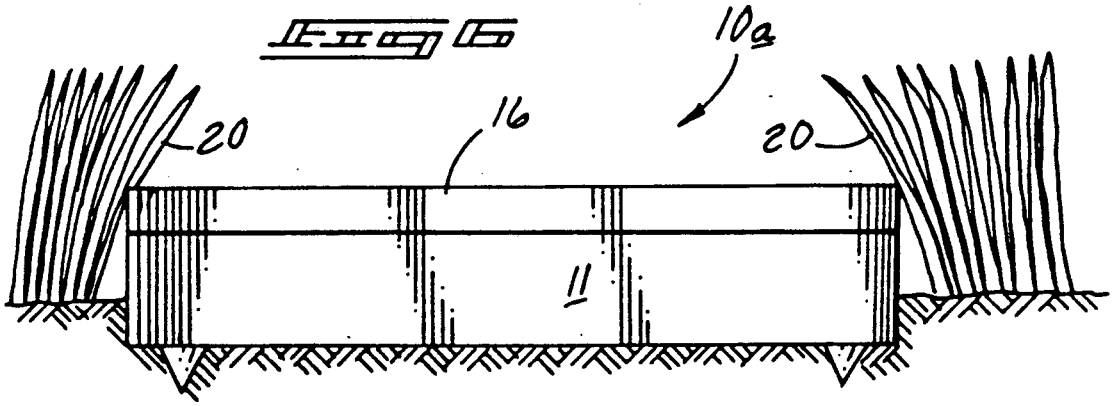
FIG. 6 is an orthographic side view taken in elevation of the modification of the instant invention in position within a lawn forum.
Figure 7:
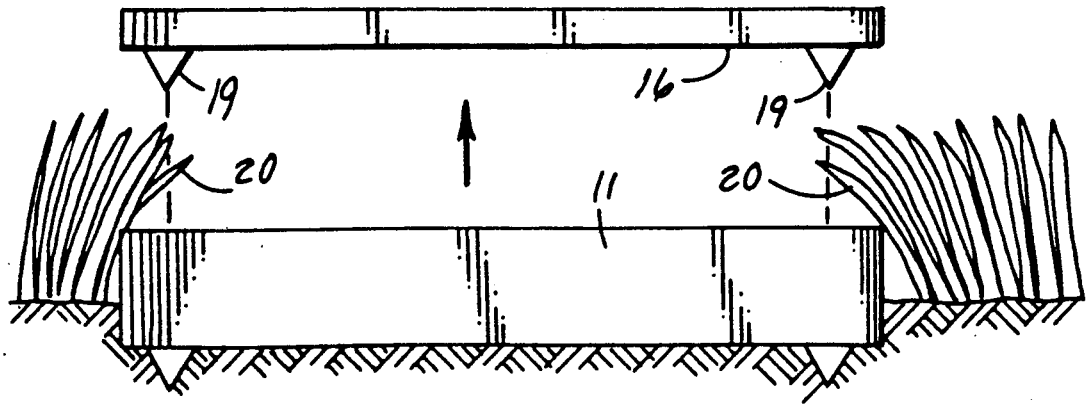
FIG. 7 is an orthographic side view taken in elevation, somewhat exploded, illustrating the raising of a secondary support block in use with the instant invention.
Figure 8:
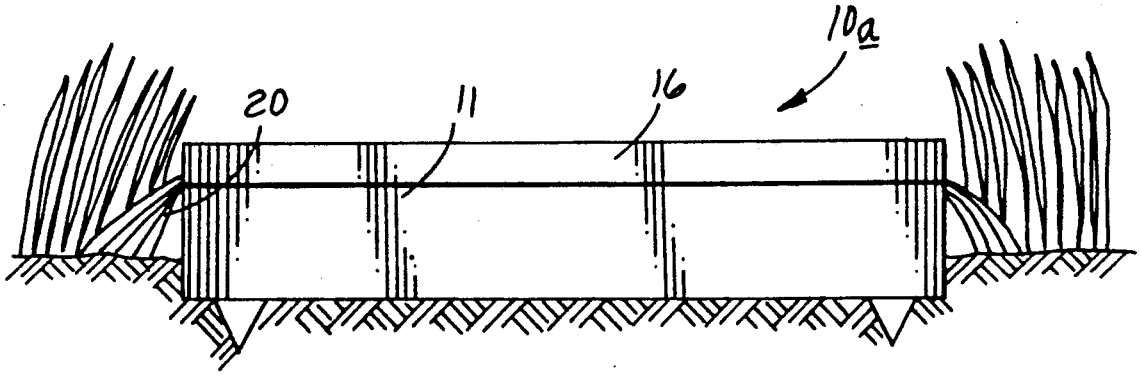
FIG. 8 is an orthographic side view taken in elevation of the secondary support block returned to its original position capturing elongate grasp members.

FIG. 5 illustrates a modified sprinkler head guard 10*a*, wherein the main support block 11 includes first registration bores axially parallel to and offset relative to the central cylindrical bore 13 and positioned at corners of the top surface of the main support block, with first projections 15 directed orthogonally downwardly and coaxially aligned with the registration bores 14. The first projections 15 are of a generally conical configuration whose base diameter is substantially equal to the registration bore diameter 14 defined by each of the registration bores 14. In this manner, secondary support blocks 16 of a coextensive geometric configuration to the top surface of the main support blocks 11 are positionable thereon to provide varying height adjustments in use of the head guard organization 10*a*. Further, the secondary support block 16 is readily utilized in trimming of surrounding grass blades 20 that are in a surrounding adjacent relationship relative to the modified sprinkler head guard, wherein the secondary support block 16 is merely lifted and its second projections 19 are removed from registration from the underlying first registration bores 14. The secondary support block 16 includes second registration bores 18 coaxially aligned and extending orthogonally downwardly from the top surface of each of the secondary support blocks in coaxial alignment, as noted, with the second projections 19 extending orthogonally and exteriorly of the bottom surface of each of the secondary support blocks. FIG. 8 illustrates the surrounding grass members 20 captured between a bottom surface of the secondary support block 16 and a top surface of the main support block 11 to accordingly kill the surrounding grass blades with a minimal of effort without resort to lawn trimming apparatus.

Figure 9:
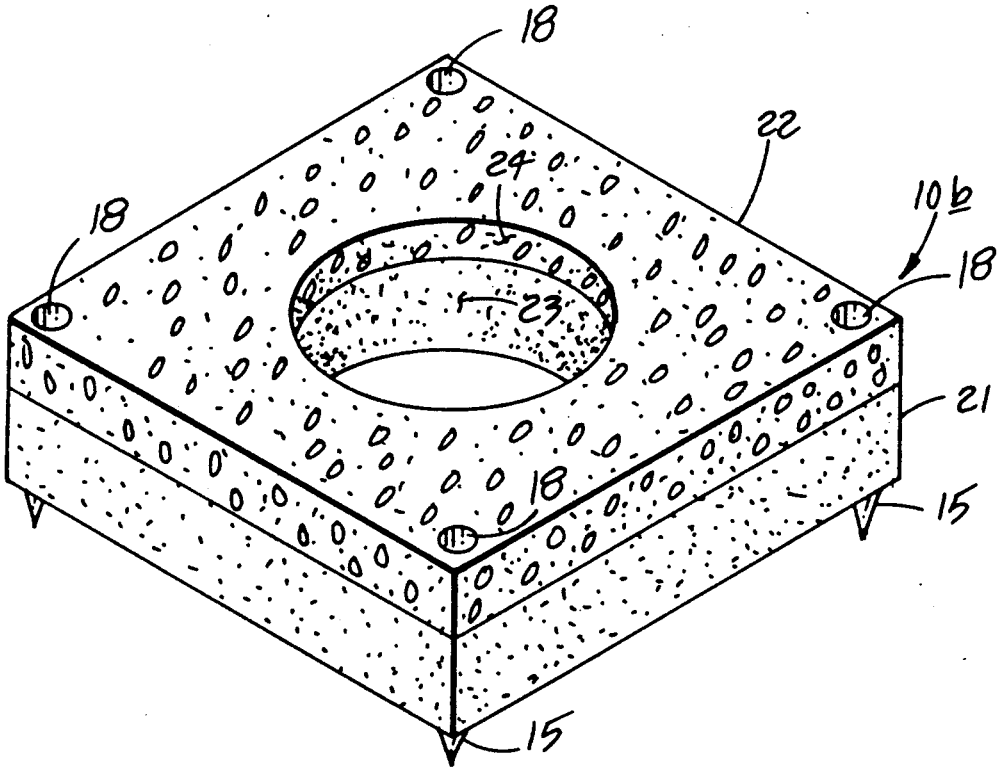
FIG. 9 is an isometric illustration of a further modified sprinkler head guard of the instant invention.

FIG. 9 illustrates a further modified sprinkler head guard 10*b* utilizing a main support block 21 defined by a concrete base, and the first projections 15 directed orthogonally downwardly in a like manner, as described relative to base 11. An absorbent polymeric secondary support block 22 of a like configuration to that of the secondary support block 16, with associated second registration bores 18 and second projections 19 (not shown) receivable within first registration bores 14 within the support block 21 are provided in an interfitting relationship, as illustrated in FIG. 5. The main and secondary support blocks 21 and 22 are accordingly provided with a medially directed central aperture 23 and 24 respectively to receive a sprinkler head therewithin. The absorbent polymeric layer defining the secondary support block 22 permits absorption of various chemicals, such as weed killers and the like, to minimize undesirable growth of grass in a surrounding relationship relative to the sprinkler head organization 10*b*, as illustrated.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A sprinkler head guard apparatus comprising, a main support block, including a top surface spaced from and parallel to a bottom surface, and a central cylindrical bore orthogonally directed through the block extending from the top surface through the bottom surface, and a tubular sleeve removably mounted within the block coaxially aligned and in surrounding relationship relative to the central cylindrical bore extending from the top surface through the bottom surface, wherein the central cylindrical bore accepts a sprinkler head in a surrounding relationship relative thereto, and wherein the support block includes a plurality of first registration bores directed orthogonally and downwardly from the top surface and spaced a predetermined spacing from the central cylindrical bore, and the first registration bores spaced apart an equal distance relative to one another, and the main support block further including a series of first projections extending orthogonally and downwardly from the bottom surface of the support block coaxially aligned with the first registration bores.

2. An apparatus as set forth in claim 1 wherein the first projections are conical.

3. An apparatus as set forth in claim 2 further including a secondary support block, wherein the main support block is defined by a predetermined height and the secondary support block is defined by a further predetermined height less than the predetermined height, and the secondary support block is defined by a secondary top surface and a secondary bottom surface of a substantially equal configuration relative to the top surface and the bottom surface respectively of the main support block, and the secondary support block including secondary registration bores directed orthogonally and downwardly from the secondary top surface, and further including secondary projections extending orthogonally and downwardly from the secondary bottom surface of the secondary support block, the secondary projections of a conical configuration and coaxially aligned with the secondary registration bores, and a secondary central cylindrical bore directed medially and coaxially through the secondary support block coextensive with the central cylindrical bore of the main support block, and the secondary registration bores and the secondary projections spaced from the secondary cylindrical bore the predetermined spacing, and the secondary registration bores and the secondary projections coaxially aligned with the first registration bores and the first projections when the secondary projections are received within the first registration bores.

4. An apparatus as set forth in claim 3 wherein the first registration bores are defined by a first registration bore diameter, and the secondary projections are of a conical configuration whose base diameter is substantially equal to a diameter defined by the first registration bores.

5. An apparatus as set forth in claim 4 wherein the secondary support block is formed of an absorbent polymeric material to permit absorption of lawn chemicals minimizing undesirable vegetations growth about a secondary support block.

* * * * *